US008025088B2

(12) United States Patent
Kim

(10) Patent No.: US 8,025,088 B2
(45) Date of Patent: Sep. 27, 2011

(54) DUAL ROLL BLIND SYSTEM

(76) Inventor: Jung-Min Kim, Yangju-Si (KR)

( * ) Notice: Subject to any disclaimer, the term of this patent is extended or adjusted under 35 U.S.C. 154(b) by 190 days.

(21) Appl. No.: 12/306,358

(22) PCT Filed: Jul. 3, 2007

(86) PCT No.: PCT/KR2007/003227

§ 371 (c)(1),
(2), (4) Date: Dec. 23, 2008

(87) PCT Pub. No.: WO2008/004805

PCT Pub. Date: Jan. 10, 2008

(65) Prior Publication Data

US 2009/0283224 A1 Nov. 19, 2009

(30) Foreign Application Priority Data

Jul. 5, 2006 (KR) ..... 10-2006-0062931
May 29, 2007 (KR) ..... 10-2007-0052099

(51) Int. Cl.
*A47H 1/00* (2006.01)
*A47G 5/02* (2006.01)

(52) U.S. Cl. ..... 160/120; 160/242; 160/321; 160/125

(58) Field of Classification Search ..... 160/120, 160/126, 85, 86, 179, 242, 237, 263, 321, 160/323.1, 343
See application file for complete search history.

(56) References Cited

U.S. PATENT DOCUMENTS 2,702,081 A * 2/1955 North et al. ..... 160/120
3,980,122 A * 9/1976 Takazawa ..... 160/85
7,089,819 B2 * 8/2006 Yabe et al. ..... 74/89.4
2004/0016312 A1 * 1/2004 Yabe et al. ..... 74/89.4
2006/0027339 A1 * 2/2006 Hsu ..... 160/120

FOREIGN PATENT DOCUMENTS

JP 10-17647 6/1998
KR 20-0419359 6/2006
WO WO 2004051047 6/2004

* cited by examiner

*Primary Examiner* — Blair M Johnson
*Assistant Examiner* — Jaime F Cardenas-Garcia
(74) *Attorney, Agent, or Firm* — IPLA P.A.; James E. Bame

(57) ABSTRACT

A dual roll blind system is able to adjust a light shading rate or extent and comprises a winding roll which includes a roll casing rotatably supported between both side plates of a ceiling bracket; a driving winding roll which includes a moving member disposed between both side plates in parallel with the winding roll and is thread-engaged with a screw shaft rotating by means of a blind winding device of one side, a straight moving member which is provided for left and right straight movements by restricting the rotation of the moving member, and a roll casing engaged with the moving member and the straight moving member; a first blind material of which upper end is fixed at the winding roll and in which a light transmission part and a light non-transmission part having constant widths are alternately formed in a width wise direction; a second blind material of which upper end is fixed at the driving winding roll and which has a light transmission part and a light non-transmission part corresponding to the first blind material and is movable left and right; and a counterweight bar which fixes a lower end of the first blind material with a lower end of the second blind material being slidably inserted into the counterweight bar in a parallel direction.

14 Claims, 6 Drawing Sheets

[Fig. 1]
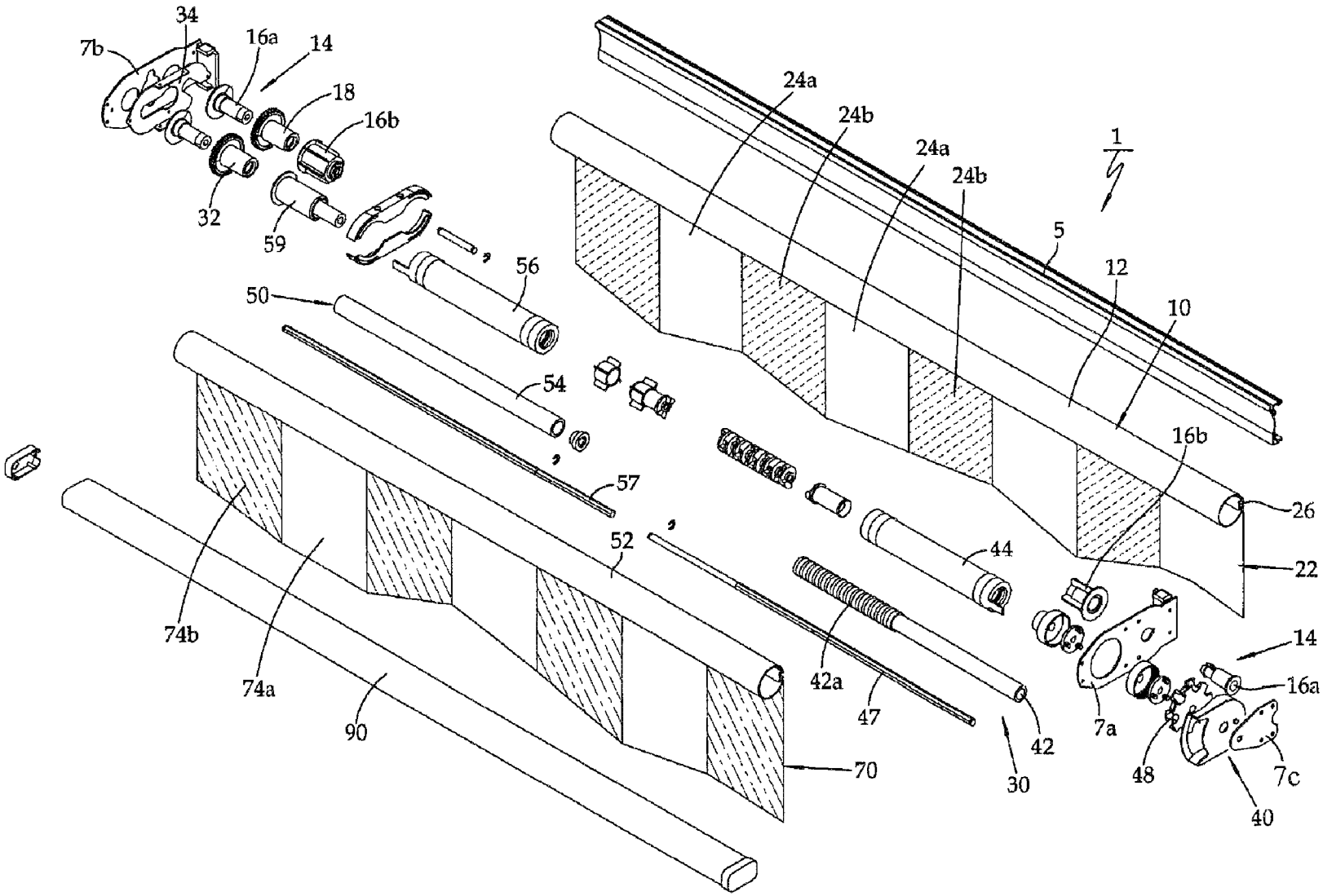

[Fig. 2]
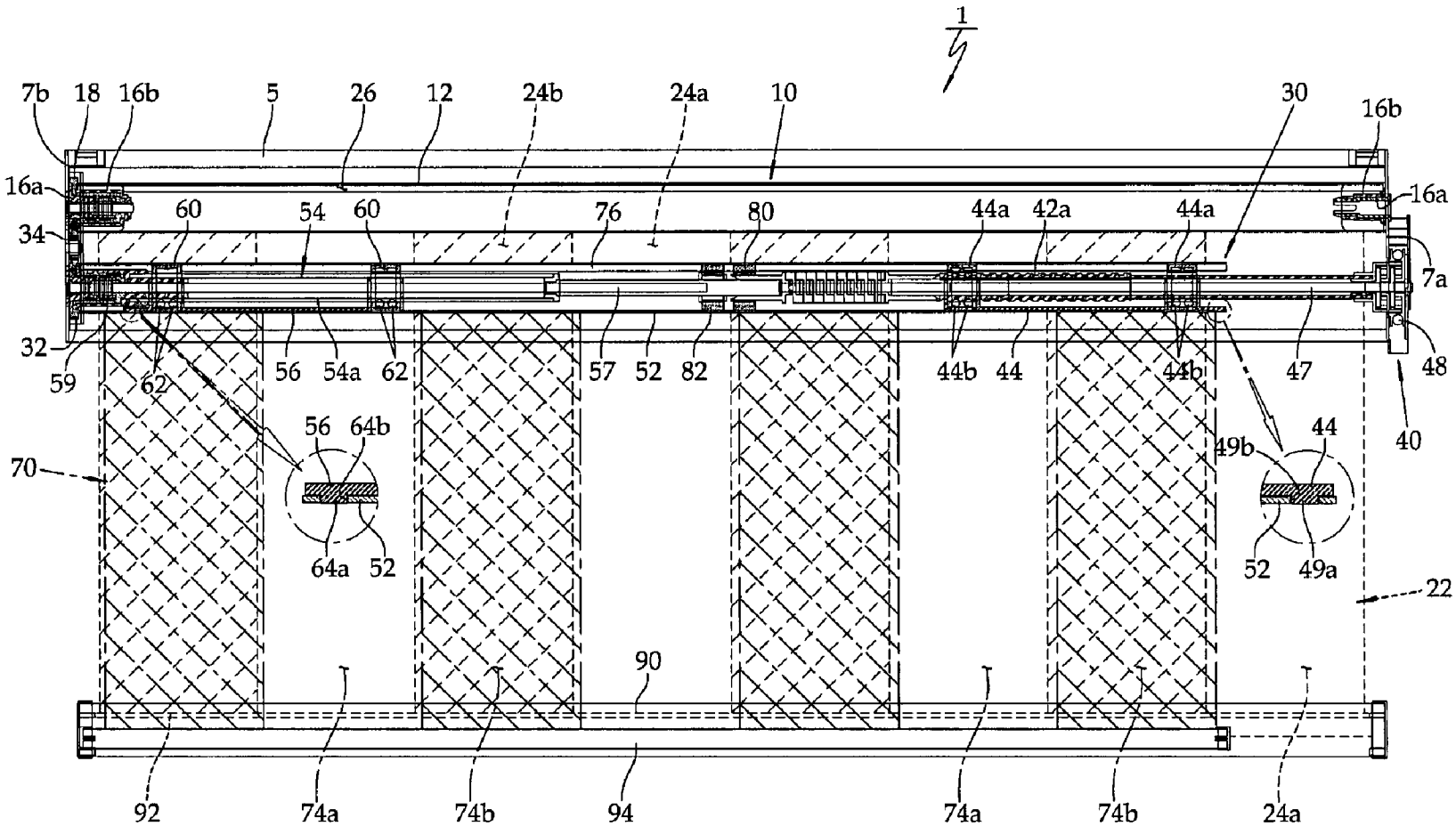

[Fig. 3]
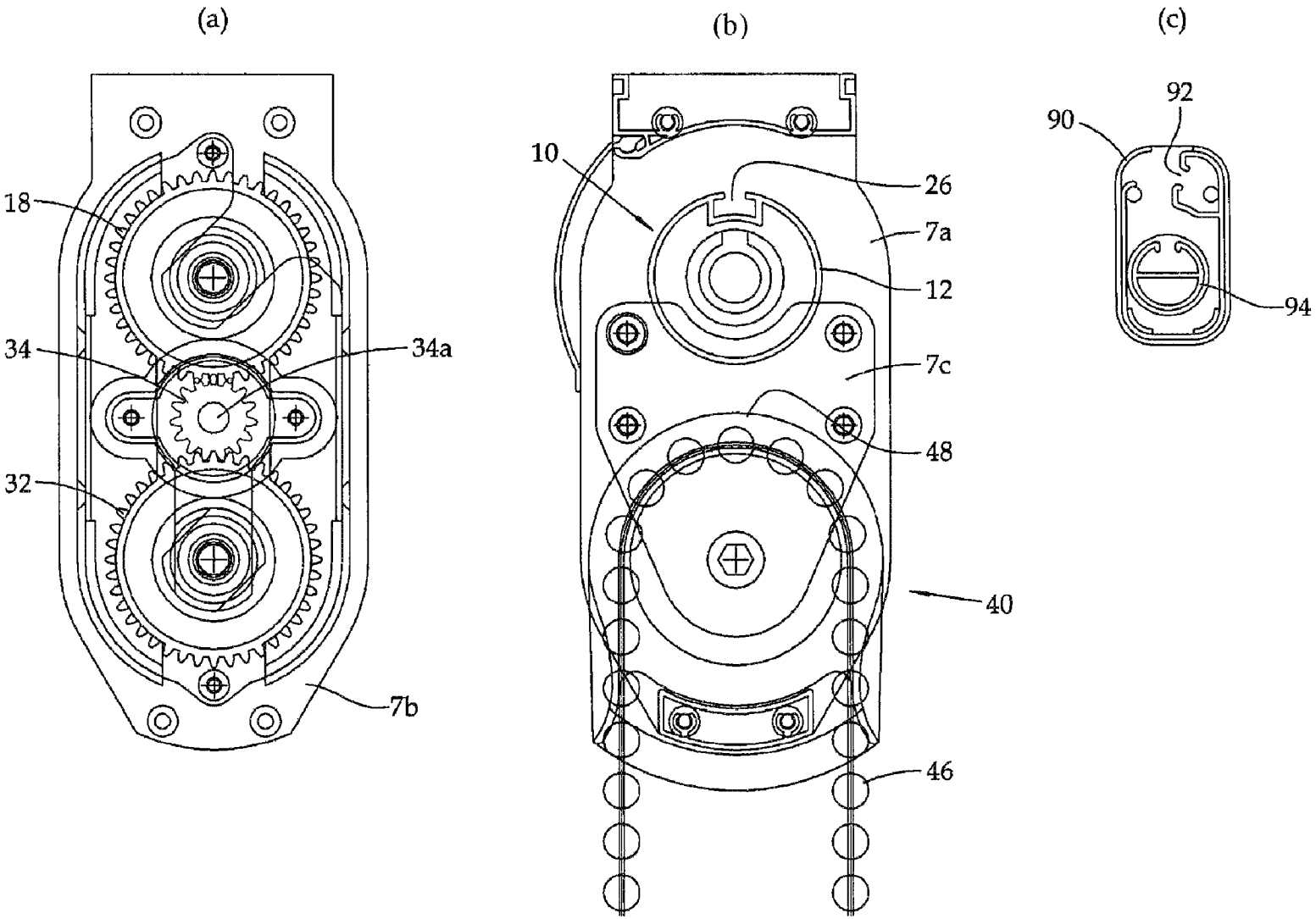

[Fig. 4]
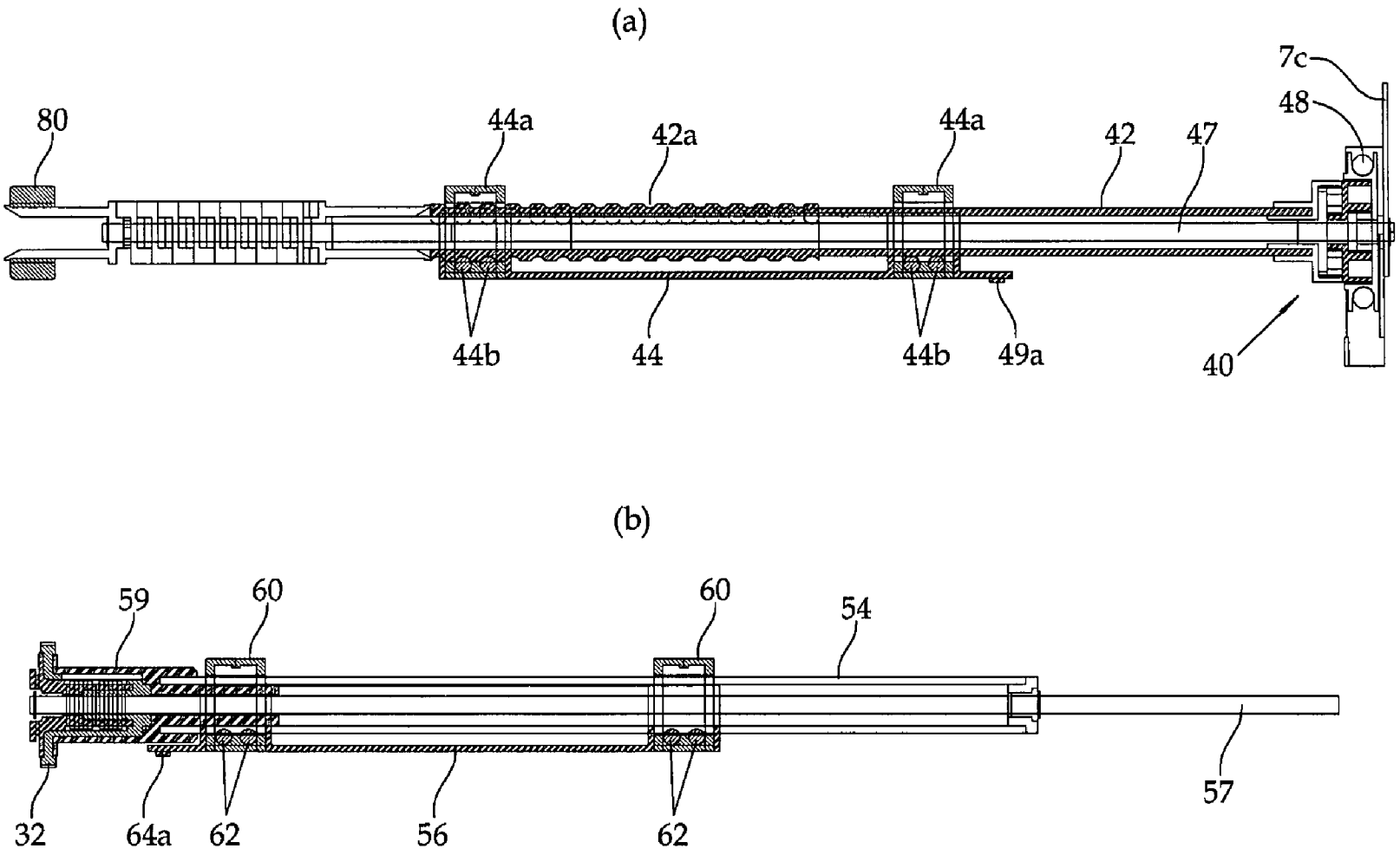

[Fig. 5]
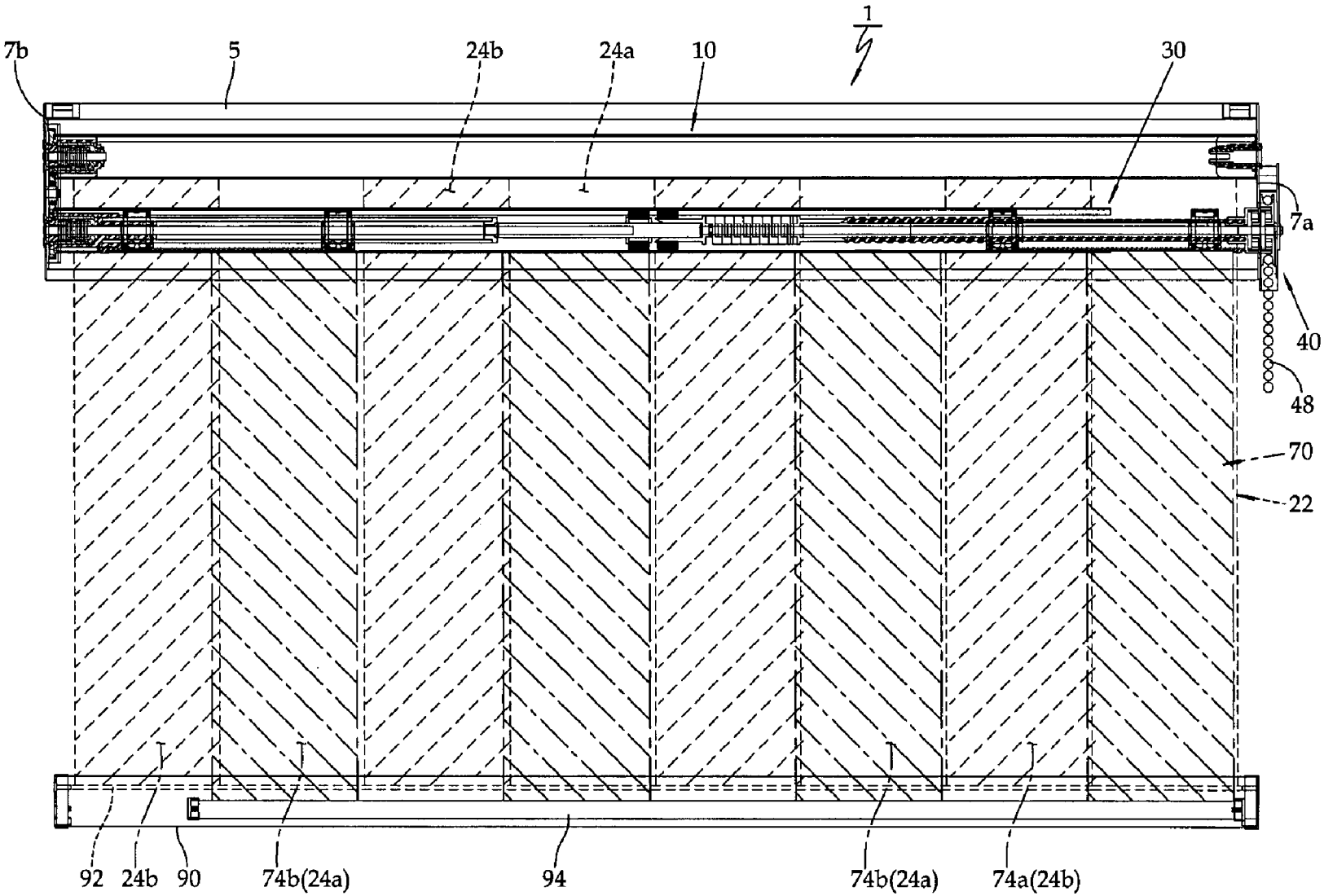

[Fig. 6]
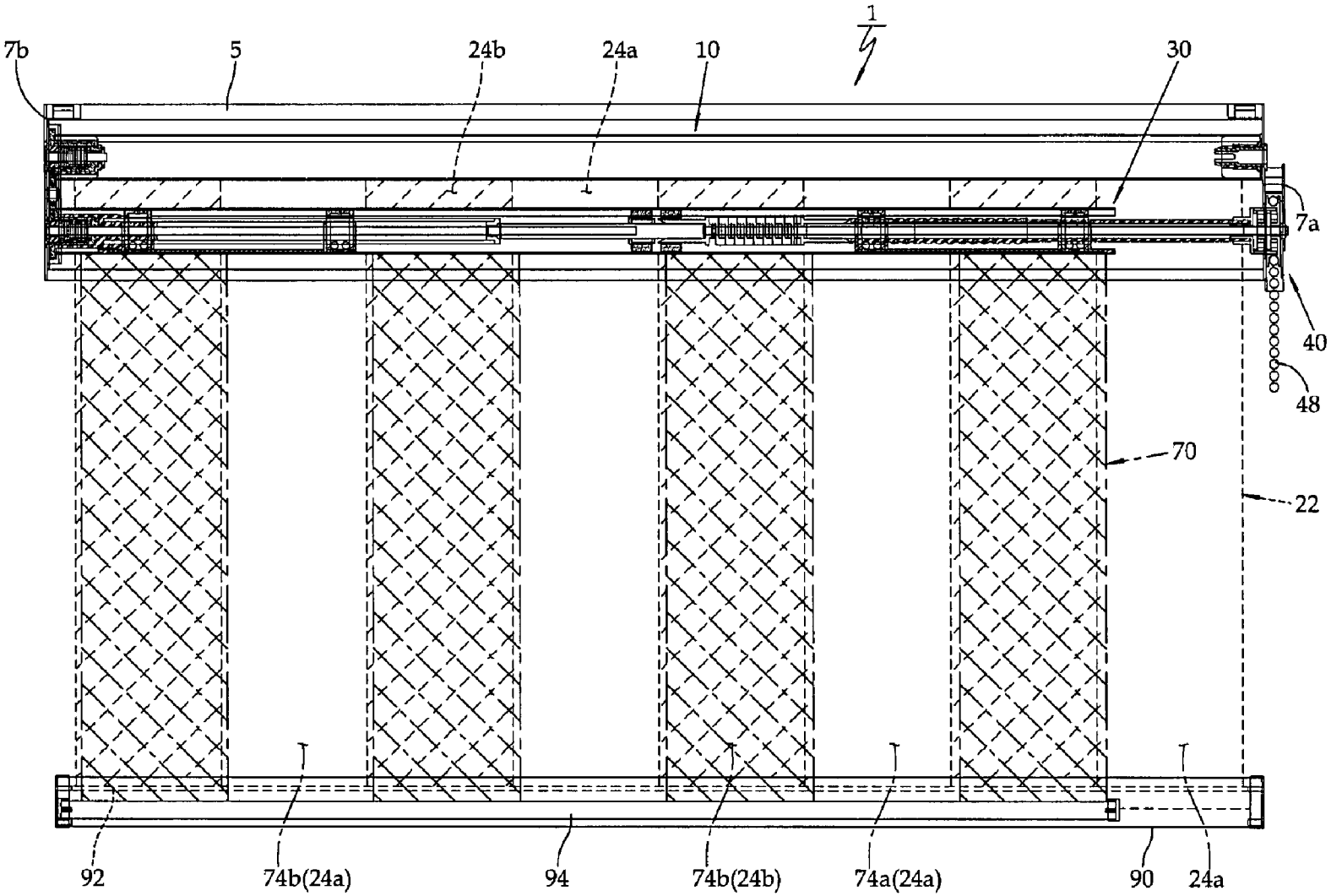

DUAL ROLL BLIND SYSTEM

BACKGROUND OF THE INVENTION

The present invention relates to a dual roll blind system which is able to adjust a light shading rate or extent, and in particular to a dual roll blind system in which it is possible to easily adjust an indoor light shading function as a light transmission part and a light non-transmission part formed on two blind materials are overlapped by moving at least one of two blind materials in a left or right direction with the help of an operation chain, and it is possible to easily adjust an up and down height.

As disclosed in a Korean utility model registration number 20-0401004, a conventional blind system is designed to perform a light transmission, partial light shading, and full light shading operation by adjusting an overlapping of two sheets of a polarization screen by moving one of two winding rolls using a feeding part having a cam.

The conventional blind system is provided with a winding roll feeding apparatus which is formed of a horizontal movement cam shaft, a bracket, a chain wheel and an operation chain as well as a screen winding apparatus formed of a chain wheel and an operation wheel which rotate a winding roll. So, the structure is so complicated, and manufacturing the same costs too much. It is needed to separately operate the winding apparatus and the feeding apparatus, thus causing many inconvenience when in use. In addition, since a winding roll is pushed and fed with the help of a difference between a long direction size and a short direction size in a horizontal direction movement with a sliding friction contact in a horizontal direction with one surface of a gear in a state that an elastic force of a spring keeps being applied to a winding roll, the winding roll, which moves while compressing the spring, does not maintain a fed state by means of an increased elastic force of the spring, so that it may move in a direction that a user does not want. In addition, since it is impossible to feed a winding roll by a long distance due to its structure in a horizontal direction, a width of the vertical polarization part and the horizontal polarization part should be small at the polarization screen. So, when a light shading is present in a partial state, it is impossible to provide a much opening feeling.

SUMMARY OF THE INVENTION

Accordingly, it is an object of the present invention to overcome the problems encountered in the conventional art.

It is another object of the present invention to provide a dual roll blind system for adjusting a light shading rate or extent by means of an overlapping operation by horizontally moving in a left direction or a right direction one of two blind materials having a light transmission part and alight non-transmission part each having a constant width, so that a structure is simplified, and it is possible to decrease a cost needed for a manufacture and maintenance.

It is further another object of the present invention to provide a dual roll blind system which obtains a reliable indoor light shading operation as well as an easier blind material height, for an easier use, an excellent operation reliability and durability.

To achieve the above object, there is provided a dual roll blind system which is able to adjust a light shading rate or extent, a dual roll blind system which comprises a winding roll which includes a roll casing rotatably supported between both side plates of a ceiling bracket; a driving winding roll which includes a moving member disposed between both side plates in parallel with the winding roll and is thread-engaged with a screw shaft rotating by means of a blind winding device of one side, a straight moving member which is provided for left and right straight movements by restricting the rotation of the moving member, and a roll casing engaged with the moving member and the straight moving member; a first blind material of which upper end is fixed at the winding roll and in which a' light transmission part and a light non-transmission part having constant widths are alternately formed in a width wise direction; a second blind material of which upper end is fixed at the driving winding roll and which has a light transmission part and a light non-transmission part corresponding to the first blind material and is movable left and right; and a counterweight bar which fixes a lower end of the first blind material with a lower end of the second blind material being slidably inserted into the counterweight bar in a parallel direction.

In the present invention, it is possible to adjust a light shading rate or extent based on an overlapping state of a light transmission part and another light transmission part or a light transmission part and a non-light transmission part by horizontally moving one of two blind materials in a left direction or a light direction in which a light transmission part and a light non-transmission part having a constant width are alternately formed. A structure is simplified, and manufacturing and maintenance cost are low.

In addition, it is possible to obtain a desired light shading effect by moving a blind material with a simple operation of an operation chain without an additional structure and operation. An up and down height can be freely adjusted. The use is simple, and a reliable operation of an excellent light shading effect can be obtained. An excellent durability is obtained in the present invention.

BRIEF DESCRIPTION OF THE DRAWINGS

FIG. 1 is a disassembled perspective view illustrating a dual roll blind system according to the present invention.

FIG. 2 is a cross sectional view illustrating a dual roll blind system according to the present invention.

FIGS. 3A through 3C are detailed views illustrating a dual roll blind system according to the present invention, of which:

FIG. 3A is a view illustrating a construction of a driving gear, an intermediate gear, and a driven gear;

FIG. 3B is a view illustrating a blind winding device; and

FIG. 3C is a view illustrating a structure of a counterweight bar; and

FIGS. 4A and 4B are detailed cross sectional views illustrating a dual roll blind system according to the present invention, of which:

FIG. 4A is a cross sectional view illustrating an engaging structure of a screw shaft and a moving member; and FIG. 4B is a cross sectional view illustrating a spline shaft and a running member; and FIG. 5 is a side cross sectional view illustrating a state that a blind material is wound or unwound as a roll casing of a driving winding roll is closer to a right side in a dual roll blind system according to the present invention; and FIG. 6 is a side cross sectional view illustrating a state that a blind material is wound or unwound as a roll casing of a driving winding roll is closer to a left side in a dual roll blind system according to the present invention.

DETAILED DESCRIPTION OF THE INVENTION

To achieve the above object, there is provided a dual roll blind system which is able to adjust a light shading rate or extent, a dual roll blind system which comprises a winding roll which includes a roll casing rotatably supported between both side plates of a ceiling bracket; a driving winding roll which includes a moving member disposed between both side plates in parallel with the winding roll and is thread-engaged with a screw shaft rotating by means of a blind winding device of one side, a straight moving member which is provided for left and right straight movements by restricting the rotation of the moving member, and a roll casing engaged with the moving member and the straight moving member; a first blind material of which upper end is fixed at the winding roll and in which a light transmission part and a light non-transmission part having constant widths are alternately formed in a width wise direction; a second blind material of which upper end is fixed at the driving winding roll and which has a light transmission part and a light non-transmission part corresponding to the first blind material and is movable left and right; and a counterweight bar which fixes a lower end of the first blind material with a lower end of the second blind material being slidably inserted into the counterweight bar in a parallel direction.

A driven gear is engaged at one side end of the winding roll, and a driving gear is engaged at one side end of the driving winding roll, and the driven gear and the driving gear are engaged with each other via an intermediate gear and integrally rotate.

The straight moving part of the driving winding roll comprises a spline shaft which is positioned opposite to the thread shaft and has the coaxes with the thread shaft, and a running member which is slidably engaged at the spline shaft and moves straight along the thread shaft and the spline shaft as the roll casing is engaged at the running member.

The preferred embodiments of the present invention will be described with reference to the accompanying drawings.

As shown in FIGS. 1 and 2, the dual roll blind system 1 according to the present invention comprises a winding roll 10 having a roll casing 12 rotatably supported between side plates 7*a* and 7*b* of a ceiling bracket 5.

The winding roll 10 is designed so that both ends of the cylindrical roll casing 12 are rotatably engaged at the side plates 7*a* and 7*b* of the ceiling bracket 5 with a bearing 14.

The bearing 14 comprises a rotary shaft 16*a* fixed at the side plates 7*a* and 7*b*, respectively, and a ring shaped rotation sleeve 16*b* is inserted into the rotary shaft 16*a*, and the both ends of the roll casing 12 are inserted into the rotation sleeve 16*b*. A driven gear 18 is connected with a rotation sleeve 16*b* of one side of the winding roll 10. The driven gear 18 rotates by means of a driving gear 32 of the driving winding roll 30 which will be described later.

An upper end of a first blind material 22 is fixed at the winding roll 10, so that a light transmission part 24*a* and a light non-transmission part 24*b* each having a constant width are alternately formed in a width wise direction. The first blind material 22 is inserted into a groove 26 longitudinally formed at the roll casing 12 of the winding roll 10 and is integrally formed at the winding roll 10 via a fixing member (not shown).

The dual roll blind system 1 according to the present invention comprises a driving winding roll 30 which is disposed between side plates 7*a* and 7*b* in parallel with the winding roll 10. The driving winding roll 30 comprises a moving member 44 which is thread-engaged with a screw shaft 42 rotating by means of the blind winding device 40 of one side, a straight moving member 50 which enables a straight left and right movement by restricting the rotation of the moving member 44, and a roll casing 52 which is engaged at the moving member 44 and the straight moving member 50.

A driving gear 32 is engaged at one side end of the driving winding roll 30. The driven gear 18 and the driving gear 32 are thread-engaged with each other via an intermediate gear 34 and integrally rotate.

As shown in FIG. 3A, there is provided a gear connection structure in which it is connected with the driven gear 18 of the winding roll 10 from the driving gear 32 of the driving winding roll 30 via the intermediate gear 34. The driving gear 32 is engaged at one side of the driving winding roll 30 and rotates. The intermediate gear 34 rotates as the rotary shaft 34*a* of the same is rotatably connected with the side plate 7*b*. The driven gear 18 is rotatably engaged at one side of the winding roll 10. With the above structure, the rotational force of the driving gear 32 is transferred to the driven gear 18 via the intermediate gear 34. More preferably, the driven gear 18 and the driving gear 32 have the same diameters, so that they rotate at the same circumference speed.

In addition, the driving winding roll 30 has a blind winding device 40 which is rotatably disposed at the side plate 7*a* of the ceiling bracket 5, so that a user can rotate the same.

As shown in FIGS. 2 and 3B, the driving winding roll 30 comprises a blind winding device 40 which is engaged at the side plate 7*a* so that a chain wheel 48 connected with an operation chain 46 pulled by a user can rotate.

The blind winding device 40 is closer to an outer side of the side plate 7*a* via a side plate cover 7*c* and comprises a screw shaft 42 which is rotatably engaged at the chain wheel 48 of the winding device 40, and a moving member 44 which is thread-engaged at the screw shaft 42.

As shown in FIGS. 2 and 4A, the moving member 44 comprises a plurality of nuts 44*a* thread-engaged at the screw groove 42*a* of the screw shaft 42, and a plurality of balls 44*b* which are disposed in the nut 44*a* and rotate in the screw groove 42*a*, so that it moves on the same with the help of the rotation of the screw shaft 42.

The core 47 of the center of the screw shaft 42 is connected with the center of the chain wheel 48 via the side plate 7*a* and is rotatable on the side plate 7*a*. A screw groove 42*a* is formed at an outer surface of the screw shaft 42.

The nuts 44*a* of the moving member 44 are positioned in the screw groove 42*a* of the screw shaft 42, and a plurality of balls 44*b* are provided at the nuts 44*a* and rolls along the screw groove 42*a*. The moving member 44 has an elastic protrusion 49*a* at one side and is integrally inserted into the hole 49*b* of the roll casing 52 outwardly inserted.

The driving winding roll 30 has a straight moving member 50 which allows the moving member 44 to move straight while restricting the rotation of the moving member 44 with respect to the screw groove 42*a* of the screw shaft 42 at the other side of the moving member 44.

The straight moving member 50 comprises a spline shaft 54 which is coaxial with the screw shaft 42 opposite to the screw shaft 42 of the moving member, and a running member 56 which is slide-engaged at the spline shaft 54. The other side of the roll casing 52 is engaged at the running member 56.

As shown in FIGS. 2 and 4B, in the straight moving member 50, the center core 57 of the spline shaft 54 is fixed at the side plate 7*b* of the other side of the ceiling bracket 5, and the spline shaft 54 is rotatably engaged at the core 57, and the rotation sleeve 59 having the driving gear 32 is integrally connected at one side of the spline shaft 54. So, the spline shaft 54 is integrally connected with the rotation sleeve 59 and the driving gear 32 and is rotatable on the core 57.

The running member 56 is slide-engaged on the spline shaft 54. The running member 56 integrally connects a plurality of running blocks 60 positioned at the straight groove 54*a* of the spline shaft 54. Here, the running blocks 60 have a plurality of balls 62 which move on the spline shaft 54 and smoothly move along the straight groove 54*a* of the spline shaft 54.

The running member 56 has an elastic protrusion 64*a* at one side and is integrally inserted into the hole 64*b* of the roll casing 52 which is outwardly inserted. So, one end of the roll casing 52 of the driving winding roll 30 is fixed at the moving member 44, and the other end of the same is fixed at the running member 56. The moving member 44 and the running member 56 have the same structure for providing an easier manufacture.

In the driving winding roll 30, the roll casing 52 has the same outer diameter as the roll casing 12 of the winding roll 10. When the driving winding roll 30 and the winding roll 10 rotate with the same revolutions, they have the same circumferential speed. Here, the roll casing 52 of the driving winding roll 30 has a shorter length as compared to the roll casing 12 of the winding roll 10 for the reason that the roll casing 52 of the driving winding roll 30 moves left and right in the longitudinal direction.

The upper end of the second blind material 70 is fixed at the roll casing 52 of the driving winding roll 30 like the roll casing 12 of the winding roll 10. The light transmission part 74*a* and the light non-transmission part 74*b* having the constant widths are alternately formed in a width wise direction like the first blind material 22. The upper end of the second blind material 70 is inserted into the groove 76 longitudinally formed in the roll casing 52 of the driving winding roll 30.

The upper end of the second blind material 70 is fixed at the driving winding roll 30, and the light transmission part 74*a* and the light non-transmission part 74*b* are alternately formed while corresponding to the first blind material 22.

In the driving winding roll 30, a position fixing ring 80 is engaged at a front end of the screw shaft 42, and the screw shaft 42 is coaxial with the center of the roll casing 52. In the driving winding roll 30, a position fixing ring 82 is engaged at a front end of the spline shaft 54, and the spline shaft 54 is coaxial with the center of the roll casing 52.

As shown in FIG. 2, the inner diameter of the position fixing ring 82 is larger than the diameter of the core 57 of the spline shaft 54, so that the roll casing 52 can smoothly rotate.

The dual roll blind system 1 according to the present invention comprises a counterweight bar 90 into which the lower end of the second blind material 70 is slidably inserted in a horizontal direction with the lower end of the first blind material 22 being fixed at the counterweight bar 90.

As shown in FIG. 3C, in the counterweight bar 90 a fixing groove 92 is provided at the inner side of the same with a lower end of the first blind material 22 being integrally connected with the fixing groove 92. A lower end of the second blind material 70 is fixed, and the moving rod 94 slidably moves at the inner side of the counterweight bar 90 in a longitudinal direction.

The length of the moving rod 94 corresponds to the roll casing 52 of the driving winding roll 30, and the diameter of the same is smaller than the inner diameter of the counterweight bar 90. In the counterweight bar 90, it moves along with the second blind material 70 connected with the roll casing 52 of the driving winding roll 30.

In the present invention, the light transmission parts 24*a* and 74*a* and the light non-transmission parts 24*b* and 74*b* having the same widths are alternately formed in the width wise directions at the first blind material 22 and the second blind material 70, respectively. The second blind material 70 fixed between the driving winding roll 30 and the moving rod 94 moves left and right with respect to the first blind material 22 fixed between the winding roll 10 and the counterweight bar 90 and allows the light transmission parts 24*a* and 74*a* and the light non-transmission parts 24*b* and 74*b* to match with each other for thereby controlling a light shading rate or extent.

So as to move the second blind material 70, a user uses the winding device 40 provided at one side of the driving winding roll 30.

When a user pulls an operation chain 46, the pulling force allows the screw shaft 42 to rotated as it is transferred to the same via the chain wheel 48. The rotational force of the screw shaft 42 allows the moving member 44, which is connected with the screw groove 42*a* of the screw shaft 42 via the nut 44*a* in which the balls 44*b* are positioned, and the roll casing 52, of which one side is connected with the moving member 44, to rotate together.

The other side of the roll casing 52 is connected with the running member 56, and the running member 56 is positioned in the groove 54*a* of the spline shaft 54 via the balls 62 of the running block 60. The running member 56 is disposed in the groove 54*a* of the spline shaft 54 via the balls 62 of the running block 60. The spline shaft 54 is engaged with the intermediate gear 34 and the driven gear 18 via the driving gear 32 and transfers a driving force to the winding roll 10. With the above structure, it is possible to provide a certain restriction to the rotation so that the spline shaft 54 does not rotate.

The spline shaft 54 does not rotate by means of the rotation restriction, and the running block 60 provided at the running member 56 of the straight moving part 50 moves straight along the spline shaft 54. Namely, in the blind winding device 40, as the user pulls one end of the operation chain 46, the screw shaft 42 rotates in one direction. The moving member 44 thread-engaged with the rotating screw shaft 42 moves straight along the screw shaft 42 with the help of the rotation restriction operation of the spline shaft 54. So, the roll casing 52 fixed at the moving member 44 and the running member 56 moves straight in the left and right directions along the screw shaft 42.

In this case, in the driving winding roll 30, the roll casing 52 horizontally moves along the screw shaft 42 in the left or right direction, and the second blind material 70 fixed at the roll casing 52 moves left and right while keeping closer to the first blind material 22. So, as the light transmission part 74*a* and the light non-transmission part 74*b* of the second blind material 70 fixed at the driving winding roll 36 move horizontally, the light transmission part 24*a* and the light non-transmission part 24*b* provided at the first blind material 22 fixed at the winding roll 10 are overlapped with the light transmission part 74*a* and the light non-transmission part 74*b* provided at the second blind material 70 fixed at the driving winding roll 30, so that a light shading rate or extent can be selectively adjusted.

At this time, the lower end of the second blind material 70 is connected with the moving rod 94 which is movable in a longitudinal direction at an inner side of the counterweight bar 90, so that it stably moves. As a result, the light transmission part 24*a* and the light non-transmission part 24*b* of the first blind material 22 are overlapped with the light transmission part 74*a* and the light non-transmission part 74*b* of the second blind material 70.

As shown in FIG. 5, the driving winding roll 30 moves to the left most portion by pulling one side of the operation chain 46, and the outer side surface of the roll casing 52 becomes closer to the side plate 7*a* of the ceiling bracket 5. Even when a user continuously pulls the operation chain 46, the roll casing 52 thread-engaged with the screw shaft 42 does not move left.

When the roll casing 52 of the driving winding roll 30 does not move right, the rotational force of the roll casing 52 by means of the operation chain 46 overcomes the rotational restriction obtained by means of the driving gear 32, the intermediate gear 34 and the driven gear 18 for thereby allowing the roll casing 52 to rotate in one direction.

So, the spline shaft 54 engaged with the roll casing 52 rotates in the same direction as the roll casing 52, so that the driving gear 32 of the spline shaft 54 rotates. As the driving gear 32 rotates, the roll casing 12 of the winding roll 10 having the driven gear 18 rotates via the intermediate gear 34.

With the concurrent rotation of the driving winding roll 30 and the winding roll 10, the first blind material 22 and the second blind material 70 are concurrently wound on the driving winding roll 30 and the winding roll 10, and the heights of the same can be adjusted shorter.

As shown in FIG. 6, the driving winding roll 30 is moved to the left most side by pulling the other side of the operation chain 46. When the outer surface of the roll casing 52 moves and reaches closer to an outer surface of the driving gear 32, the user keeps pulling the operation chain 46, and the roll casing 52 engaged with the screw shaft 42 rotates in the reverse direction.

Since the roll casing 52 of the driving winding roll 30 no more moves left, the rotational force of the roll casing 52 by means of the operation chain 46 overcomes the restriction force to the rotation obtained by means of the driving gear 32, the intermediate gear 34 and the driven gear 18 for thereby allowing the roll casing 52 to rotate in the reverse direction.

So, the spline shaft 54 engaged with the roll casing 52 rotates in the same direction, and the driving gear 32 connected with the spline shaft 54 rotates, so that the driven gear 18 rotates via the intermediate gear 34, and the winding roll 10 rotates.

The concurrent rotations of the driving winding roll 30 and the winding roll 10 allow the second blind war material 70 fixed at the driving winding roll 30 and the first blind material 22 fixed at the winding roll 10 to concurrently unwind and to extend down. As the first blind material 22 and the second blind material 70 wind and unwind, the first blind material 22 and the second blind material 70 are wound on or unwound from the driving winding roll 30 and the winding roll 10, so that the upper and lower heights of the first and second blind materials 22 and 70 can be adjusted.

When the roll casing 52 of the driving winding roll 30 is at the intermediate position, not closer to the right side or not closer to the left side, the rotation of the screw shaft 42 by means of the operation chain 46 allows the roll casing 52 to move only in the left and right directions by way of the operation of the straight moving part 50. As the second blind material 70 moves left and right with respect to the first blind material 22, the light transmission part 74*a* and the light non-transmission part 74*b* of the second blind material 70 are overlapped with the light transmission part 24*a* and the light non-transmission part 24*b* of the first blind material 22 for thereby selectively adjusting the light shading rate or extent. In addition, as the first blind material 22 and the second blind material 70 wind on or unwind from the driving winding roll 30 and the winding roll 10, the upper and lower height of the first and second blind materials 22 and 70 are adjusted.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

In the present invention, it is possible to adjust a light shading rate or extent based on an overlapping state of a light transmission part and another light transmission part or a light transmission part and a non-light transmission part by horizontally moving one of two blind materials in a left direction or a light direction in which a light transmission part and a light non-transmission part having a constant width are alternately formed. A structure is simplified, and manufacturing and maintenance cost are low.

The invention claimed is:

1. A dual roll blind system which is able to adjust degree of a light shading, a dual roll blind system, comprising:

a winding roll which includes a roll casing rotatably supported between both side plates of a ceiling bracket;

a driving winding roll, which includes a moving member disposed between both the side plates of the ceiling bracket, is disposed in parallel with the winding roll, and is thread-engaged with a screw shaft rotating by means of a blind winding device at one side, a straight moving member which is provided for left and right straight movements by restricting the rotation of the moving member, and a roll casing engaged with the moving member and the straight moving member;

a first blind material whose upper end is fixed at the winding roll and in which a light transmission part and a light non-transmission part having constant widths are alternately formed in a width wise direction;

a second blind material whose upper end is fixed at the driving winding roll and which has a light transmission part and a light non-transmission part corresponding to the first blind material and is movable left and right; and a counterweight bar, at which a lower end of the first blind material is fixed, and into which a lower end of the second blind material is slidably inserted in a parallel direction to the lower end of the first blind material, wherein said straight moving member of the driving winding roll comprises a spline shaft which is positioned opposite to the screw shaft and is coaxial with the screw shaft, and a running member which is slidably engaged at the spline shaft and moves straight along the screw shaft and the spline shaft as the roll casing is engaged at the running member.

2. The system of claim 1, wherein a driven gear is engaged at one end of the winding roll, and a driving gear is engaged at one end of the driving winding roll, and the driven gear and the driving gear are engaged with each other via an intermediate gear, and the driven gear, the driving gear, and the intermediate gear rotate together.

3. The system of claim 2, wherein said driven gear and said driving gear have the same sizes and rotate at the same speed.

4. The system of claim 1, wherein said roll casing of the winding roll and said roll casing of the driving winding roll have the same outer diameter.

5. The system of claim 1, wherein said moving member includes a plurality of nuts thread-engaged with the screw groove of the screw shaft, and said nuts have a plurality of balls rolling in the thread groove and are thread-engaged with the screw shaft.

6. The system of claim 5, wherein said moving member has an elastic protrusion at one side of the same and is integrally inserted into a hole of the roll casing.

7. The system of claim 1, wherein said running member comprises a plurality of running blocks positioned in the straight groove of the spline shaft, and each of said running blocks includes a plurality of balls moving on the spline shaft and is engaged on and moves straight on the spline shaft.

8. The system of claim 7, wherein said running member has an elastic protrusion at one side of the engaging member and is inserted into a hole of the roll casing.

9. The system of either claim 6 or claim 8, wherein said moving member and said running member have the same structure.

10. The system of claim 1, wherein said driving winding roll is disposed as a position fixing ring is engaged at a front end of a thread shaft, and the screw shaft is coaxial with the center of the roll casing.

11. The system of claim 1, wherein said driving winding roll is disposed as a position fixing ring is engaged at a front end of a spline shaft, and the spline shaft is coaxial with the center of the roll casing.

12. The system of claim 11, wherein an inner diameter of said position fixing ring is larger than the diameters of the screw shaft and the spline shaft, respectively.

13. The system of claim 1, wherein in said winding roll, both side ends of the roll casing are rotatably engaged at both side plates of the ceiling bracket via the bearings.

14. The system of claim 1, wherein said counterweight bar has a fixing groove integrally connected with a lower end of the first blind material, and a moving rod fixed with a lower end of the second blind material is slidable in a longitudinal direction at an inner side of the counterweight bar.

* * * * *